United States Patent [19]

Maqueo-Cario

[11] Patent Number: 4,805,369

[45] Date of Patent: Feb. 21, 1989

[54] STRUCTURAL MODULE FOR CONSTRUCTION OF ROOFS

[76] Inventor: Agustin Maqueo-Cario, No. 175, Rosas St., Col. Terreón Jardín, Torreon, State of Coahuila, Mexico

[21] Appl. No.: 559,776

[22] Filed: Dec. 9, 1983

[30] Foreign Application Priority Data

Apr. 4, 1983 [MX] Mexico ..... 196810

[51] Int. Cl.[4] ..... F04C 1/00

[52] U.S. Cl. ..... 52/600; 52/583; 52/587

[58] Field of Search ..... 52/600, 596, 587, 583

[56] References Cited

U.S. PATENT DOCUMENTS

| | | | |
|---|---|---|---|
| 2,635,450 | 4/1953 | Orzel | 52/583 |
| 3,951,085 | 4/1976 | Johnson et al. | 52/587 |
| 4,038,793 | 8/1977 | Roca | 52/587 X |
| 4,080,765 | 3/1978 | Fasano | 52/587 X |
| 4,164,831 | 8/1979 | Messick et al. | 52/587 X |
| 4,397,583 | 8/1983 | Horney et al. | 52/587 X |

*Primary Examiner*—J. Karl Bell

*Attorney, Agent, or Firm*—McAulay, Fields, Fisher, Goldstein & Nissen

[57] ABSTRACT

A poured concrete modular element is disclosed for supporting a roof or the like whereby a plurality of the modular elements may be interconnected in a novel manner and connected with the covering to form a monolithic element. The modular element comprises a rectangular shaped member having side faces of substantially equal length whereby the corners of the side faces are each provided with circular concave inwardly recesses. Extending outwardly from the recesses are circular members. Approximately centrally located in each side face are two vertically spaced holes and centrally disposed openings are provided in each recess. The modular elements may be interconnected at their corners by inverting one element with respect to the element and placing a fastening element through the then aligned openings. Concrete may be poured in the cylindrical opening formed by the corners of two adjacent modules to connect together the modules. The bottommost hole in the side faces is adapted to receive a support to support the elements and the uppermost hole is adapted to receive a table support for supporting a platform for pouring of a concrete slab, whereby, upon pouring of such concrete slab, a monolithic construction is provided.

6 Claims, 4 Drawing Sheets

STRUCTURAL MODULE FOR CONSTRUCTION OF ROOFS

SUMMARY OF THE INVENTION

This application refers to a novel and useful structural element of a prefabricated type for the erection of covers or roofs of buildings, which consists of a small size rectangular hollow element which is provided in its external vortexes with coupling elements, in the way of dovetailed elements which allow the joining of one of those modules with four respective modules in such a way that the structural roof of a building may be erected independently from its dimension.

BACKGROUND OF THE INVENTION

It is common in the construction of roofs for buildings, to build them with the assistance of a falsework on which the concrete is poured before the erection of the corresponding structural reinforcement. In most cases of erection of covers or roofs it is also common to use lightening elements which help to conform the filtered slab in situ, duly lightened by lower hollowings of such slab.

The above mentioned prior art, which constitutes a background of public knowledge, has been largely divulged and accepted in the construction field, as it may be applied in a wide diversity of constructions with the only requirement of a preliminary calculation of resistances, by using rods of various diameters and suitable superelevations, depending on the spaces to be covered, and besides of other proper considerations or of considerations within the reach of professionals devoted to the buildings design and construction art.

The prefabricated structural element, useful in the erection of roofs, of the invention, allows the quick construction of roofs without using a previous falsework in the area or space to be covered and on the basis that it is manufactured in factories, it can be exhaustively submitted to various resistance proofs in such a way that it may constitute a reliable and eminently good element depending on the application of its destination, as its assembly, rise, dimensions, etc., will be estimated depending on the requirements and specific characteristics of a particular structure or else, its construction may be normalized to be used in works of similar span, in such a way that its construction be limited to a few standards with the view to attain a lowering in the cost of the construction.

Therefore, it is a main object of the invention, the construction of a prefabricated structural element, for the erection of roofs, slabs or ceilings, with which use the falsework in the space to be covered is avoided, which element is provided with assembly elements which permit to apply it without the assistance of expert builders.

It is still another object of the invention to provide an structural element for the erection of structural roofs, made as a prefabricated element, so avoiding the attendance of experts in the erection of the falsework, in the construction of said slab, as well as of experts in the structural reinforcement, thus attaining the lowering in the cost of the construction.

It is still another object of the invention to provide the structural element under resistive standard dimensions and specifications, which lowers still more the cost in the construction works.

These and other objects will be widely covered by the invention which protection is requested, as it will become evident from the detailed description afterwards given, based on a specific style, according to the attached drawings, in which.

Figure 1:
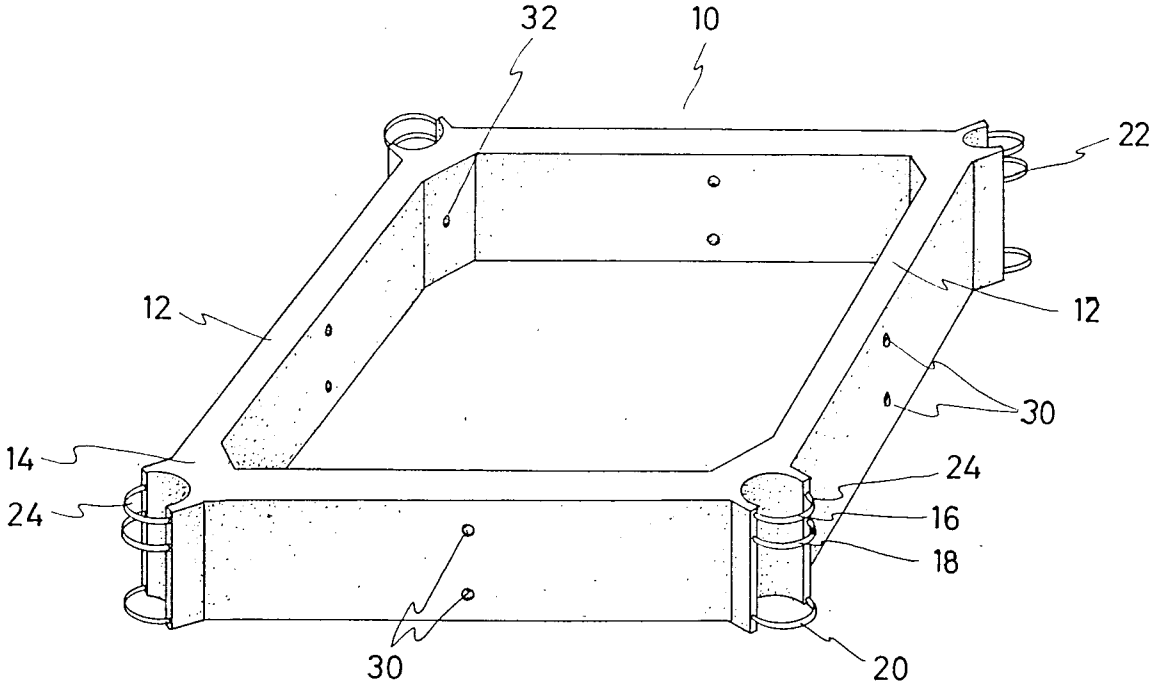
FIG. 1 is a view in conventional perspective, of the prefabricated structural element of the invention.

As it is shown in the attached drawings, particularly in FIGS. 1 to 4, the prefabricated structural module of the invention, which is illustrated with the general reference 10, constitutes a rectangular build with side faces 12 of identical length, provided in its vortexes with nodules 14 which externally form a semicircular hollow 24.

In the nodules 14, there are placed three semicircular tying elements 16, 18 and 20, conformed as a prolongation of the structural hoops 16', 18', and 20', which constitute, jointly with the structural elements 28, the structural reinforcement of said structural modules 10. Two of said tying elements 16 and 18 are closely placed from each other, with a separation 26, comparable to the thickness of the material of which said structural hoops 16', 18' and 20' are formed, plus an offsize, in such a way that they form a dovetailed system which permits to join one with the other the modules, by the inversion of one module with respect to the other one. The purpose for forming a dovetailed system from the tying semicircular elements 16, 18 and 20, will be broadly explained by FIG. 5 of the attached drawings.

Figure 3:
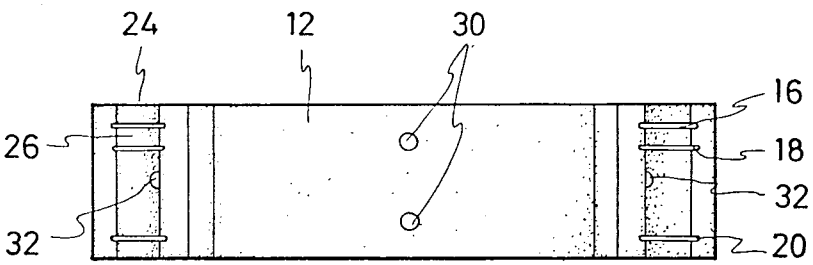
FIG. 3 is a side view of the element of the invention.
Figure 2:
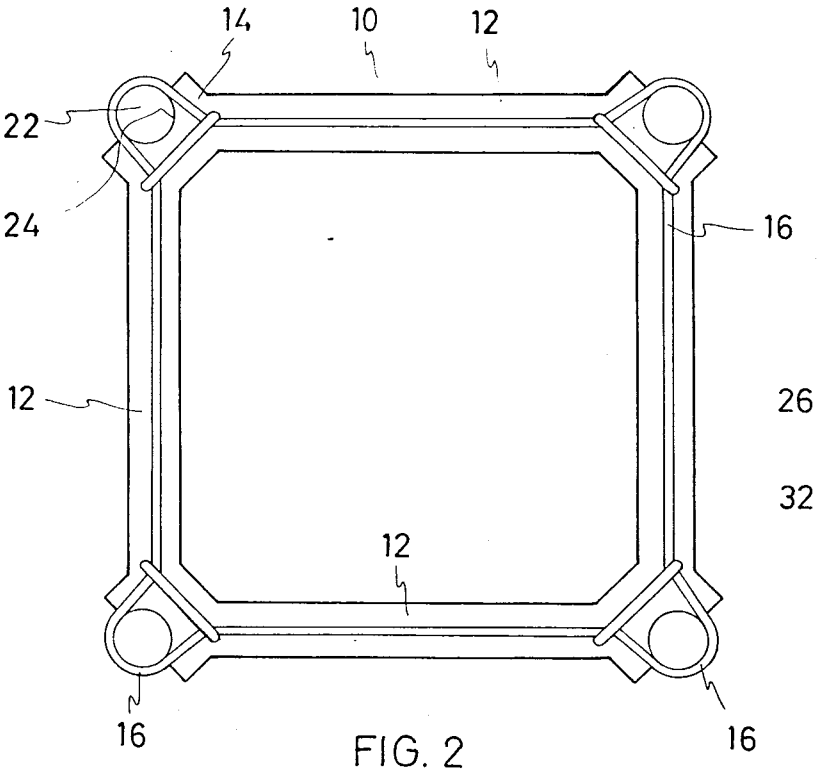
FIG. 2 is a top view of the structural element of FIG. 1, in which it has been illustrated in dotted lines, the superior hoop of the reinforcement.
Figure 4:
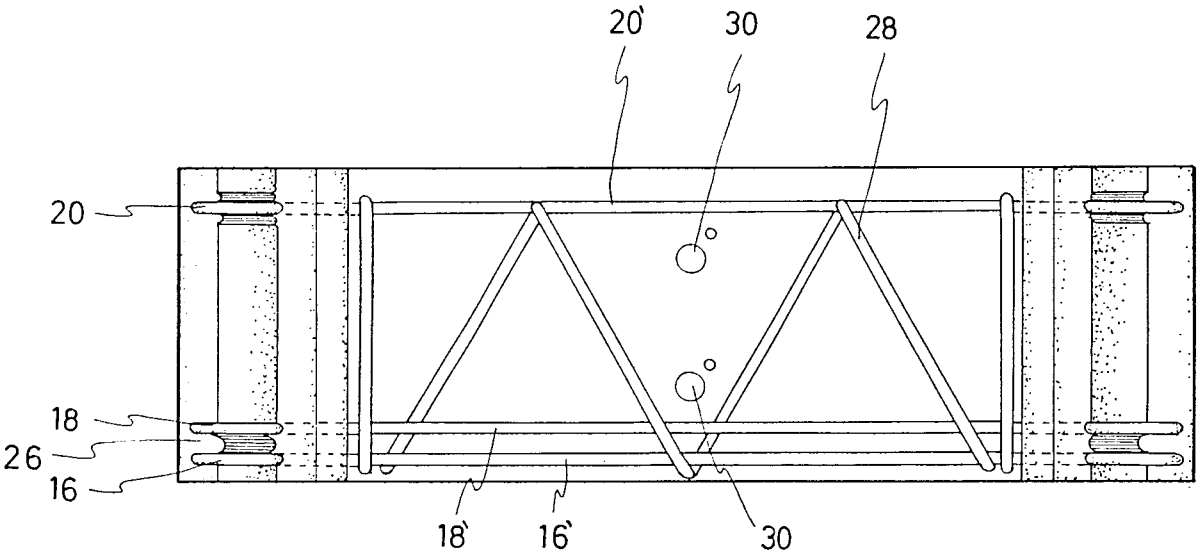
FIG. 4 shows the structural reinforcement of the modular element of the invention.
Figure 5:
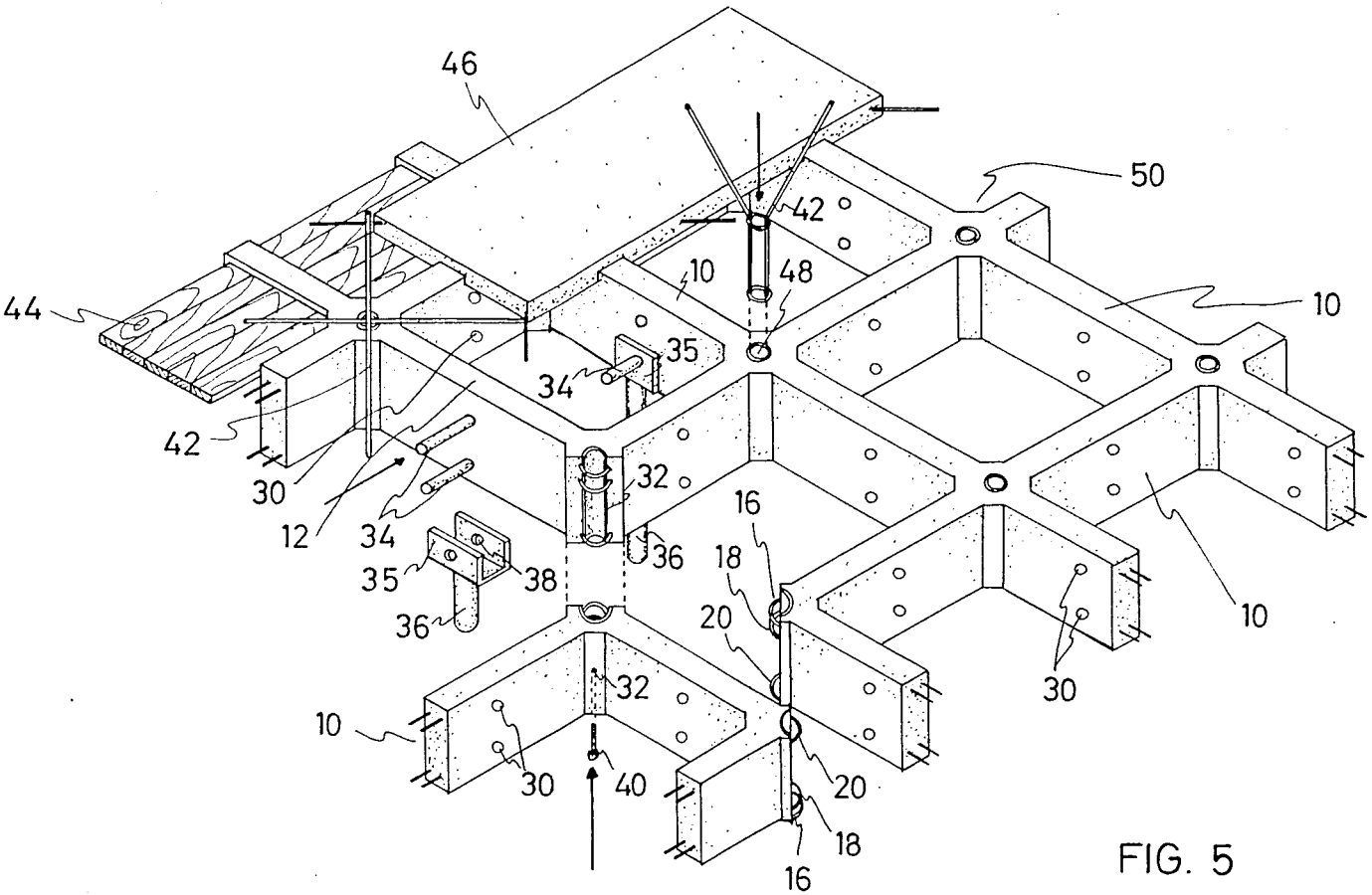
FIG. 5 is an outlook view showing in its whole the erection of a slab or roof according to the rules of the invention.

It may be seen from FIGS. 1, 3 and 4 that the side walls 12 of the module 10 of the invention carry two drills 30 and that in the hollows 24 of each nodule 14 there are disposed two drills 32—(FIG. 3), one for each hollow, which use will become apparent once the FIG. 5 is described.

Even if it is obvious the fact that the prefabricated modular structural element of the invention is manufactured by well known techniques, it is evident that until now nobody had the idea to sketch a structural module with the above described characteristics, nor to use it with the purpose to build a cover or slab, affording with said use the construction of such cover, thus reducing the cost and the time for its construction.

From the following description it may be proved the substantial modification achieved in the traditional systems for the erection of slabs or covers by using the structural element or structural module of the invention, so revolutionizing in its whole the traditional concepts used up to date in the construction field.

In FIG. 5 of the accompanying drawings it has been illustrated in a Schematic form the erection of a slab, by using the elements 10 of the invention. From said FIG. 5, it may be seen that various modules 10 have been joined in their angles by means of the pins or screws 40, which are introduced through the drills 32 disposed in the hollows 24 of the nodules 14. It may be noted from the frontal modules 10 illustrated in said FIG. 5, as partially divided, that they are reciprocally inverted to each other, in such a way to attain a coupling between the semicircular tying elements 16 and 18 with the corresponding 20 of the remaining of said modules, so obtaining an assembly or joinery between such modules of the dovetailed type, which is repeated in vicinity of superior ribs as well as of inferior ribs of the configurated entirety.

From said FIG. 5, it may be also noted that the coupling of one module 10 with the other four modules surrounding it, takes place by its nodules 14 and not laterally, all of it as it is illustrated in the above cited figure. As the cover is being formed or mounted and besides—joining each module with the other or others corresponding modules by means of the pins 40, the entirety is supported by the posts 36 duly supported in their base and fastened to the module by the corresponding pin 34, which slides into the drills 38 of the support 35 U shaped, placed at the ending of the posts 36.

Through the superior drills 30, it slides also a pin 34, in such a way that its last parts be projected to both sides of the faces 12 of the modules 10, so as to constitute the support points for the tables 44, which will be the base to pour the filtrate 46, prior to the location in the hollows 48 of the reinforcement 42 which is introduced through the tying elements 16, 18 and 20, so forming the reinforcement of the slab, which is filtered on the gridiron 50. The filtered concrete on said gridiron 50, may also fill the hollows 58 or else these may be filtered prior to the filtration of the slab 46. Anyway, the gridiron 50 and the slab 46 are monolithically integrated, being built in this way a cover in a different way to that of the different methods used up to date for building covers.

Once the poured concrete on the gridiron 50 is set, there are removed the posts 36 and the tables 44, this can be done only by removing the pins 34.

From the above description it becomes apparent that different changes or amendments in the concepts herein defined may be made, not modifying the real essence or spirit of the invention, so there is an attempt in order that such changes be considered as forming part of this application, provided that they fall within the provisions of the following claims.

What is claimed is:

1. A structural module for the construction of roofs, comprising: a rectangular member having side walls of substantially equal length; a vertically extending concave recess at each corner of said rectangular member; a plurality of vertically spaced reinforcing elements projecting outwardly from each of said concave recesses; each of said concave recesses extending from at least the topmost reinforcing element to the bottommost reinforcing element to define, together with another module in juxtaposition thereto, a cylindrical recess for the receipt of mortar to form a unitary structure; and a substantially centrally located transverse aperture extending through the walls defining each of said concave recesses, whereby holding means may be received in the apertures of adjacent modules and extend diagonally across the cylindrical recess so formed to hold said modules together during the pouring and hardening of the mortar.

2. A structural module as in claim 1, and at least a pair of vertically spaced openings in each of said side walls, each of said openings being located substantially at the middle of the respective side wall.

3. A structural module as in claim 1, in which each of said plurality of reinforcing elements comprise at least three elements, the spacing between two of said elements being substantially equal to the thickness of said wall, the third reinforcing element being spaced from said other two elements by a distance sufficient to receive the corresponding said two elements from an inverted adjacent module.

4. A structural module as in claim 3, and a second inverted module adjacent thereto, said recesses of said adjacent module defining a cylindrical opening, said elements of said recesses being received in the recess of the adjacent module.

5. A structural module as in claim 4, and a pin extending through the apertures of adjacent recesses of said modules to hold together said modules to permit the pouring of mortar into said cylindrical opening formed by said adjacent recesses.

6. A structural module as in claim 1, in which said projecting reinforcing elements extend through said side walls of said module.

* * * * *